United States Patent [19]

Andrieu et al.

[11] Patent Number: 4,586,727

[45] Date of Patent: May 6, 1986

[54] VARIABLE-HEIGHT DEVICE FOR SUPPORTING A BOOT ON A SKI

[75] Inventors: Louis Andrieu, St Pierre le Moutier; Henri Peyre, Nevers, both of France

[73] Assignee: STE LOOK, Nevers, France

[21] Appl. No.: 668,987

[22] Filed: Nov. 6, 1984

[30] Foreign Application Priority Data

Nov. 30, 1983 [FR] France ..... 83 19100

[51] Int. Cl.[4] ..... A63C 9/00

[52] U.S. Cl. ..... 280/607; 248/188.2; 280/636

[58] Field of Search ..... 248/188.2; 36/91; 280/636, 633, 618, 607

[56] References Cited

U.S. PATENT DOCUMENTS

| | | | |
|---|---|---|---|
| 3,030,730 | 4/1962 | Costar | 248/188.2 |
| 3,306,562 | 2/1967 | Bellefleur | 248/188.2 |
| 3,904,158 | 9/1975 | Michael | 248/188.2 X |
| 4,135,335 | 1/1979 | Jensen | 248/188.2 X |
| 4,135,736 | 1/1979 | Druss | 280/636 |
| 4,438,948 | 3/1984 | Gertsch | 280/636 X |

FOREIGN PATENT DOCUMENTS

| | | | |
|---|---|---|---|
| 368900 | 11/1982 | Austria . | |
| 2383681 | 10/1978 | France . | |
| 2431306 | 2/1980 | France . | |
| 212583 | 11/1940 | Switzerland | 280/636 |

*Primary Examiner*—John J. Love
*Assistant Examiner*—Michael Mar
*Attorney, Agent, or Firm*—Young & Thompson

[57] ABSTRACT

A supporting device which is adjustable for height in order to adapt ski bindings to the thickness of ski-boot soles comprises a control member guided for longitudinal sliding motion within a stationarily fixed base plate. The control member cooperates with a support plate by means of stair-step surfaces having inclined risers. The longitudinal displacement of the control member produces a vertical displacement of the support plate by wedge effect.

5 Claims, 3 Drawing Figures

VARIABLE-HEIGHT DEVICE FOR SUPPORTING A BOOT ON A SKI

BACKGROUND OF THE INVENTION

1. Field of the Invention

The present invention relates to a variable-height device for supporting a boot on a ski.

This type of device is more particularly intended to serve as a support for the standardized smooth zone of the ski-boot sole in order to limit parasitic friction forces which develop between the sole and the ski and in order to prevent these friction forces from disturbing the operation of the safety ski binding. The smooth zone mentioned above is a transverse band 40 millimeters in width. The front edge of the band is located at a distance of 30 millimeters from the toe end of the sole in the case of "adult standard" ski boots and at a distance of 25 millimeters in the case of "child standard" ski boots. It is for this reason that the device is usually integrated with the toe abutment member of a ski binding.

2. Description of the Prior Art

It is a known practice to provide boot-supporting devices which are adjustable for height in order to adapt the safety ski binding to the thickness of the ski boot employed. Provision can accordingly be made for a toe abutment member of a ski binding in which the jaw unit is stationarily fixed in the vertical direction. This not only permits a substantial reduction both in cost price and in bulk of the toe abutment member but also removes the disadvantage of lateral play which is almost inevitably encountered in jaw units which permit height adjustment.

Thus the ski-boot supporting device described in U.S. Pat. No 4,135,736 comprises a vertically displaceable support plate. Adjustment of the plate is performed by wedge effect by longitudinal displacement either of the support plate itself (FIG. 2) or one or two control elements placed beneath the support plate (FIGS. 3, 4, 6).

In the first embodiment of FIG. 2, height adjustment of the support plate entails the need for modification of its position on the ski in the longitudinal direction. In consequence, the support plate is not located continuously opposite to the standardized smooth zone of the skiboot sole, which is unsatisfactory from a safety standpoint.

In the other embodiments of FIGS. 3, 4 and 6, height adjustment of the support plate calls for preliminary slackening of the screws which serve to fix the device on the ski. The screws are thus re-tightened after suitable displacement of the control element (or elements). Now it is a well-established fact that repeated screwing and unscrewing operations performed on screws of the type employed in skis (wood-screws) eventually result in damage to the holes in which they are fitted. This is therefore a disadvantage, especially in the case of skis for hire since height adjustment operations on hired skis are frequent.

Moreover, the forms of construction which appear in the U.S. patent cited in the foregoing all suffer from a common drawback in that access to the screws and correlative height adjustment are possible only if the boot is not in position in the ski-binding. Adjustment therefore takes place by trial and error, which is somewhat irrational as well as time-consuming and is a disadvantage for the operator.

The supporting device in accordance with Certificate of Utility FR. No. 2,431,306 is similar in design to the device which has just been described and consequently suffers from the same drawbacks.

In another known boot-supporting device disclosed in patent AT. No. 368,900, height adjustment is apparently possible when the boot is in position within the ski-binding. This adjustment does not make it necessary to unscrew and re-tighten fixing screws. Locking of the support plate in the desired position is in fact achieved by means of a locking tooth formed on a resilient strip which cooperates with a set of teeth carried by a backpiece.

Unfortunately, this device is again not wholly satisfactory by reason of the fact that, as in the first embodiment (FIG. 2) of the U.S. patent mentioned earlier, height adjustment entails the need for longitudinal displacement of the support plate. Furthermore, resilient locking of the support plate by means of a single resilient tooth appears distinctly insufficient to remove any danger of accidental disadjustment of the system while skiing is in progress.

SUMMARY OF THE INVENTION

In order to improve these known devices, the present invention proposes a variable-height device for supporting a boot on a ski which permits simple and rapid height adjustment with the ski boot in position within the ski-binding and in which the vertically-displaceable support plate occupies an invariable position in the longitudinal direction of the ski. A further object of the invention is to provide an efficient system for locking the support plate in the chosen position in order to prevent any subsequent accidental disadjustment.

To this end, the ski-boot supporting device in accordance with the invention comprises:

a stationarily fixed base which is intended to be mounted on the ski, a readily accessible control member guided within the stationarily fixed base in order to slide therein along the axis of the ski, a support plate which is rigidly secured to the stationarily fixed base in a plane parallel to the ski but is capable of vertical displacement, the control member and the support plate being provided with complementary bearing surfaces in the form of stair-steps with inclined risers which extend in the longitudinal direction of the ski, resiliently actuated catch-engagement means adapted to lock the control member in the desired position.

Thus, by sliding the control member within the stationarily fixed base either by hand or by means of a screwdriver in one direction or the other, the support plate is caused to undergo a vertical displacement whilst the ski boot is applied against said plate. At the moment of completion of this displacement, the catch-engagement means have the effect of locking the control member in position and correlatively of locking the support plate in its position. These catch-engagement means are advantageously constituted by a set of teeth of triangular cross-section formed on one of said bearing faces and associated with a set of complementary indentations formed in the other surface. Thus, while permitting easy displacement of the control member, said catch-engagement means guarantee reliable and efficient locking of the device when the ski boot is in position within the ski binding since the pressure exerted by the boot on the support plate acts in opposition to disengagement of the teeth. For reasons of simplicity of manufacture and capital economy, it is an advantage to provide risers which are coplanar with the corresponding walls of the teeth and associated indentations.

It is also an advantage to ensure that the force applied to the catch-engagement means in their locking position is produced by elastic deformation of the front and rear portions of the support plate, said portions being accordingly designed in the form of flexible tongues.

The control member is preferably provided with a pair of side lugs, thereby permitting easy displacement of said control member either by hand or by means of a screwdriver.

BRIEF DESCRIPTION OF THE DRAWINGS

Other features of the invention will be more apparent upon consideration of the following description and accompanying drawings, wherein.

DETAILED DESCRIPTION OF THE INVENTION

Figure 1:
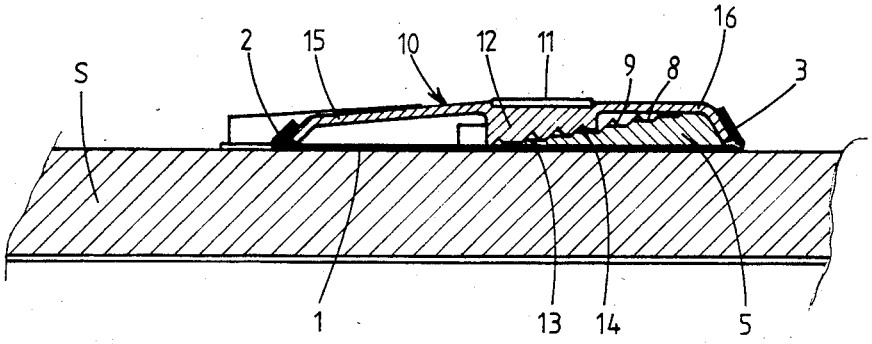
FIG. 1 is a view of the device as shown in cross-section along the vertical plane I—I of FIG. 2 and in the bottom position.

The device for supporting a boot on a ski as shown in the figures comprises a sheet metal base plate 1 which is fixed on the top face of the ski S by any suitable means such as screws (not shown in the drawings). Said base plate can also be integrated with the toe abutment member of a ski-binding (not shown), for example in the manner described in French Pat. No. 2,383,681 (FIG. 4).

With reference to the accompanying drawings, it will be understood that the front tip (not shown) of the ski S is located at the left end of each figure.

The central position 2 of the front portion of the sheet metal plate 1 as well as its rear edge 3 are bent-back at an angle which is larger than a right angle (of the order of 120° to 130°) whereas its lateral edges are bent-back at right angles so as to form side flanges 4. In consequence, the base plate 1 virtually constitutes a casing in which is mounted a control member 5 of high-strength plastic such as an acetal resin, for example. The control member 5 is guided by the lateral flanges 4 so as to permit longitudinal sliding motion within the base plate 1 and is provided with a pair of side lugs 6 passed through suitable openings formed in the flanges 4 so as to project on each side of the base plate 1. A depression 7 is formed in each lug 6 for the purpose of receiving the tip of a screwdriver. The central portion 8 of the control member has the shape of a stairway which is downwardly inclined towards the front end of the ski in the longitudinal direction. The stair-step risers are inclined with respect to the vertical at an angle of approximately 45 degrees. On each side of the central portion 8 in the lateral direction, the control member 5 is adapted to carry a set of teeth 9 of triangular cross-section, one tooth being associated with each stair-step. The crest of each tooth is located above the plane of the corresponding stair-step whilst one of the walls of the tooth is coplanar with its riser.

A small slide-plate 11 of material having a low coefficient of friction such as polytetrafluoroethylene or the like is bonded to the top face of the support plate 10. A block 12 which is integral with the support plate 10 is located beneath said plate in the vicinity of its central portion. Said block has a bottom face 13 in the form of a reversed stairway which is complementary to the portion 8 of the control member but which is shorter than this latter. Each step of said reversed stairway 13 is recessed so as to form a pair of lateral triangular grooves or indentations 14 having a shape and location corresponding to those of the teeth 9.

The front and rear portions of the support plate 10 are designed in the form of flexible tongues 15, 16, the elasticity of which is due to the nature of the material constituting the support plate, for example a synthetic material of the nylon type. The ends of the tongues 15, 16 are shaped so as to permit resilient engagement beneath the edges 2 and 3 (respectively) of the base plate 1. Thus the support plate 10 is securely attached to the base plate 1 in a plane which is parallel to the ski.

By virtue of their elasticity, said tongues urge the block 12 in the downward direction, thus powerfully applying the stair-step surface 13 against the complementary bearing surface 8 and the indentations 14 against the set of teeth 9.

Figure 2:
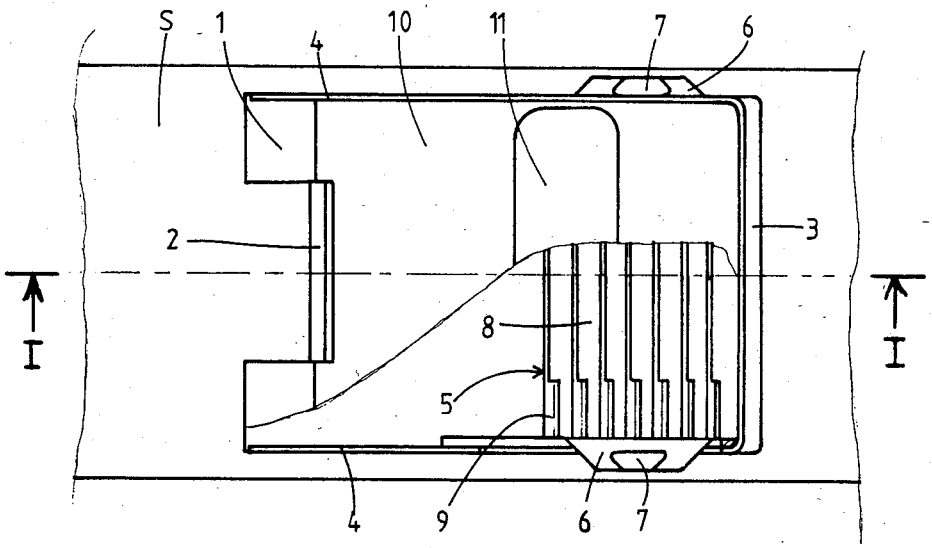
FIG. 2 is a top plan view of FIG. 1 in which the support plate has been partly cut away.

In the initial position of FIGS. 1 and 2, the control member 5 is located in the rearmost end position in which it is abuttingly applied against the flange of the tongue 16. The support plate 10 (together with its slide-plate 11) occupies its lowermost position.

Height adjustment of the device is performed as follows:

The ski boot is placed in position in the ski-binding. The standardized smooth portion of the ski-boot sole thus comes to rest on the slide-plate 11. The control member 5 is moved forward either by displacing one of the side lugs 6 by hand or by engaging the tip of a screwdriver in the depression 7 of one of the lugs in order to exert a thrust on said control member.

Figure 3:
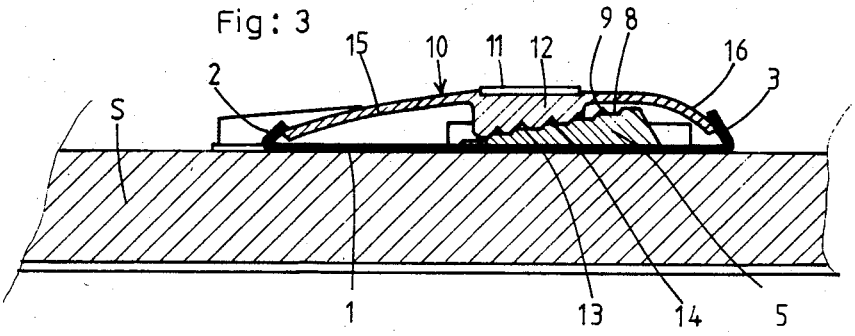
FIG. 3 is a view which is similar to FIG. 1 and in which the device is in the intermediate position.

By reason of the inclination given to the risers of the stair-step surfaces 13–8 as well as to the sets of teeth and indentations 9–14, the above-mentioned displacement of the control member produces an upward displacement of the central portion 12 (and of the slide-plate 11). This movement is made possible by the flexibility of the front portion 15 and rear portion 16 of the support plate (the deformation of which is visible in FIG. 3).

When the correct adjustment has been made and the ski-boot sole is applied against the arms of the toe abutment member, the support plate 11 is no longer capable of upward displacement. The operator consequently feels a resistance and stops the operation since the control member can no longer be moved. The indentations 13 are then applied against the teeth 9 which are in opposite relation, thus automatically locking the device in the desired position. Errors of adjustment are practically impossible, which is an important safety factor.

While the user is skiing, the pressure exerted by the ski boot is added to the force applied by the resilient tongues 15, 16 in order to produce enhanced efficiency of interlocking of the indentations 13 and teeth 9, thus practically excluding any danger of accidental disadjustment while skiing is in progress.

In order to lower the support plate 10, it is clearly only necessary to displace the control member 5 in the opposite direction (namely from front to rear).

What is claimed is:

1. A variable-height device for supporting a boot on a ski, wherein said device comprises:

a stationarily fixed base which is intended to be mounted on the ski, a readily accessible control member guided within the stationarily fixed base in order to slide therein along the axis of the ski, a support plate which is securely attached to the stationarily fixed base in a plane parallel to the ski but is capable of vertical displacement, said control member and said support plate being provided with complementary bearing surfaces in the form of stair-steps with inclined risers which extend in the longitudinal direction of the ski, and resiliently actuated catch-engagement means adapted to lock the control member in the desired position, said support plate having flexible front and rear portions of which elastic deformation has the effect of urging said catch-engagement means to the locking position.

2. A device according to claim 1, wherein the catch-engagement means are constituted by a set of teeth of triangular cross-section formed on one of said bearing faces and associated with a set of complementary indentations formed in the other bearing surface.

3. A device according to claim 2, wherein each riser of the stair-step bearing surfaces is coplanar with one of the corresponding walls of the tooth and of the associated indentation.

4. A device according to claim 1, wherein the control member is provided with a pair of side lugs so shaped as to project on each side of the stationarily fixed base.

5. A device according to claim 1, wherein the top face of the support plate is fitted with a small slide-plate formed of material having a low coefficient of friction.

* * * * *